US008733885B1

(12) United States Patent
Gardner et al.

(10) Patent No.: US 8,733,885 B1
(45) Date of Patent: May 27, 2014

(54) PRINT HEAD ARRAY TESTING

(71) Applicant: Hewlett-Packard Development Company, L.P., Houston, TX (US)

(72) Inventors: James M. Gardner, Corvallis, OR (US); Ronald A. Hellekson, Eugene, OR (US); Eric T. Martin, Corvallis, OR (US); Peter J. Fricke, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/765,742

(22) Filed: Feb. 13, 2013

(51) Int. Cl.
*B41J 29/393* (2006.01)

(52) U.S. Cl.
USPC ..... 347/19

(58) Field of Classification Search
USPC ..... 347/19, 50
See application file for complete search history.

(56) References Cited

U.S. PATENT DOCUMENTS

| | | | | |
|---|---|---|---|---|
| 5,698,987 | A * | 12/1997 | Hayashi | 347/19 |
| 6,199,969 | B1 * | 3/2001 | Haflinger et al. | 347/19 |
| 6,963,196 | B2 * | 11/2005 | Mende | 347/19 |
| 7,448,718 | B2 | 11/2008 | Haflinger | |
| 8,582,369 | B2 * | 11/2013 | Nagadomi et al. | 347/19 |

* cited by examiner

*Primary Examiner* — Kristal Feggins

(57) ABSTRACT

A method and apparatus test a printed circuit assembly and a print head array with a low-power application to a printed circuit assembly having a power storage component disconnected from a power rail of the printed circuit assembly and test the printed circuit assembly and the print head array with a high-power application to the printed circuit assembly with the printed circuit assembly receiving electrical power from the power storage component.

15 Claims, 4 Drawing Sheets

PRINT HEAD ARRAY TESTING

BACKGROUND

Print head arrays sometimes utilize energy from bulk capacitance during peak electrical demands. The print head arrays and their associated control electronics are often tested both before and after assembly into a printer. The bulk capacitance may prolong such testing and may impact test accuracy.

DETAILED DESCRIPTION OF THE EXAMPLE EMBODIMENTS

Figure 1:
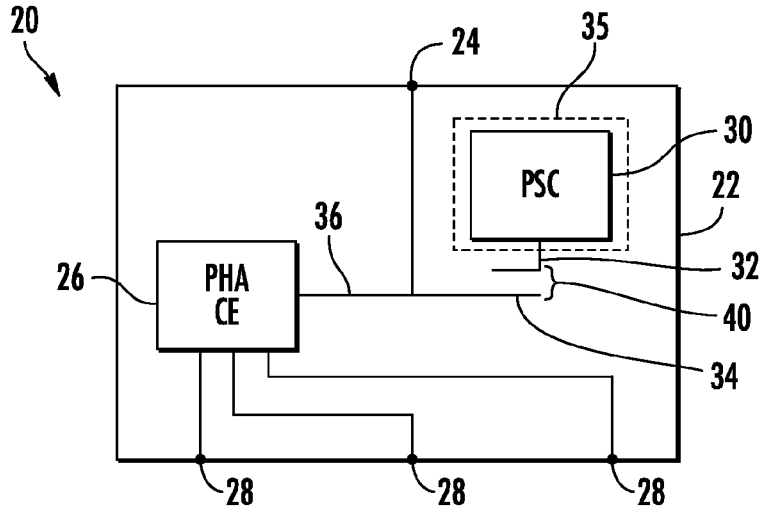
FIG. 1 is a schematic illustration of an example printed circuit assembly with a power storage component in a disconnected state.

FIG. 1 schematically illustrates an example print head array printed circuit assembly 20. As will be described hereafter, print head array printed circuit assembly 20 is configured for use with a print head array and facilitates use of large bulk capacitance to power the print head arrays during peak electrical demands. As a result, printed circuit assembly 20 may utilize lower cost components or electronics for powering and controlling the print head array. At the same time, print head array printed circuit assembly 20 minimizes or avoids testing delays due to charging of such large bulk capacitance and testing inaccuracies due to electrical leakage and charging rates of the large bulk capacitance.

Print head array printed circuit assembly 20 comprises printed circuit board 22, power input 24, print head array control electronics 26, power outputs 28, power storage component 30, electrical conductor 32, and electrical conductor 34. Printed circuit board 22 comprises a foundational support structure for printed circuit assembly 20. Printed circuit board 22 supports electrical traces as well as electronics or electrical componentry. In some implementations, printed circuit board 22 may comprise a rigid circuit board. In other implementations, printed circuit board 22 may comprise a flexible circuit board, flex circuit.

Power input 24 comprises an electrical connection on printed circuit board 22 for electrical connection to an external power supply (not shown) that regulates and changes an alternating current to a direct current. In some implementations, where a power supply is located on printed circuit board 22, but is disconnected during testing, power input 24 may be used to supply power for testing. Power input 24 supplies electrical power to print head array control electronics 26 and the print head array that is to be connected to printed circuit assembly 20.

Print head array control electronics 26 comprise of electronics or electrical components on printed circuit board 26 which selectively supply power to a print head array to selectively actuate nozzles of the print head array so as to eject ink or other fluid onto a surface in a pattern or image. Print head array control electronics 26 supplies power to the print head array through power outputs 28.

Power storage component 30 comprises one or more power storage components that provide printed circuit assembly 20 with charge storage and delivery through bulk capacitance. Power storage component 30 has a sufficient bulk capacitance to accommodate the peak electrical demands of larger, more power-consuming print head arrays which are not satisfied at peak loads by the power supplied through power input 24 from the power supply. In one implementation, power storage component 30 has a collective capacitance of at least 50 uF, nominally at least 1000 uF and at least 2500 uF in one implementation. During low power demands of the print head array, power storage component 30 is charged, utilizing power received through power input 24. During peak power demands of the print head array, during which such demands may not be adequately met by the power received through power input 24 alone, power storage component 30 supplies additional electrical power to the control electronics 26 and the print head array. Because power storage component 30 addresses the gap between peak power supply output and peak power demand of the print head array, a lower capability and less complex power supply may be used to supply power, while lower capability and less complex control electronics may be used to regulate and control the supply of power to the print head array, reducing size, cost and complexity.

Electrical conductor 32 comprises an electrically conductive structure or trace formed on printed circuit board 22 and electrically connected to power storage component 30. Electrical conductor 34 comprises an electrically conductive structure or trace formed on printed circuit board 22 and electrically connected to control electronics 26 and outputs 28 for connection to a print head array. As schematically shown in FIG. 1, electrical conductors 32 and 34 are electrically isolated from one another for low-power testing. For purposes of this disclosure, the term "low-power testing" means the application of electrical power to the printed circuit assembly so as to verify electrical connections and functionality of attached print head arrays, absent print testing. During such low-power testing, the print head arrays do not experience power peak demands which are greater than the capability of the supply of power received through power input 24 from the power supply. Because power storage component 30 is not electrically connected to the power rail 36 (schematically shown) during low-power testing, power storage component 30 is not charged and does not delay such testing. At the same time, power storage component 30 is not connected as part of the circuit being tested, wherein the electrical leakage of the power storage component 30 might be sensed and mask real impactful electrical leakage in the rest of printed circuit assembly 20.

As further schematically shown by FIG. 1, electrical conductor 32 and 34 are located in close proximity to one another to facilitate selective connection for high-power testing. For purposes of this disclosure, the term "high-power testing" means the application of electrical power to the printed circuit assembly to perform a print testing. During such high-power testing, the print head arrays experience power peak demands which are greater than the capability of the supply of power received through power input 24 from the power supply. Because electrical conductors 32 and 34 are located in close proximity to one another to facilitate selective connection, power storage component 30 may be connected to the power rail 36 to supply previously stored electrical power to the power rail 36 to address the inadequacies of the power supply during such peak power demands of the print head array during print testing. As a result, a lower capability and less complex power supply may be used to supply power and lower capability less complex control electronics 26 may be used to regulate and control the supply of power to the print head array, reducing size, cost and complexity.

In the example illustrated in FIG. 1, electrical conductor 32 comprises a first electrically conductive line having a first width. Electrical conductor 34 comprises a second electrically conductive line having a second width. Electrical conductors 32 and 34 are arranged so as to at least partially spatially overlap one another to form a shorting region 40 having a third width greater than the first width and the second width. In one implementation, electrical conductors 32 and 34 comprises non-contiguous, spaced parallel lines, such as parallel curved segments or parallel linear segments. In other implementations, other non-contiguous (not necessarily parallel) spatially overlapping arrangements may be utilized. The spatially overlapping arrangement of electrical conductors 32 and 34 facilitates reliable connection when high-power testing is to be performed and when printed circuit assembly 20 is to be placed in working order as part of a printer.

As indicated in broken lines in FIG. 1, in one implementation, power storage component 30 may be provided as part of a local power supply 35 on printed circuit board 22 or as an extension of a local power supply 35 on printed circuit board 22. One implementation, local power supply may comprise an AC to DC power supply. In another implementation, the local power supply may be a DC to DC power supply or another form of power regulator. In such an implementation, the local power supply 35 may be disconnected, along with power storage component 30, from power rail 36 during low-power testing, wherein power for the low-power testing is supplied by a remote power supply.

Figure 2:
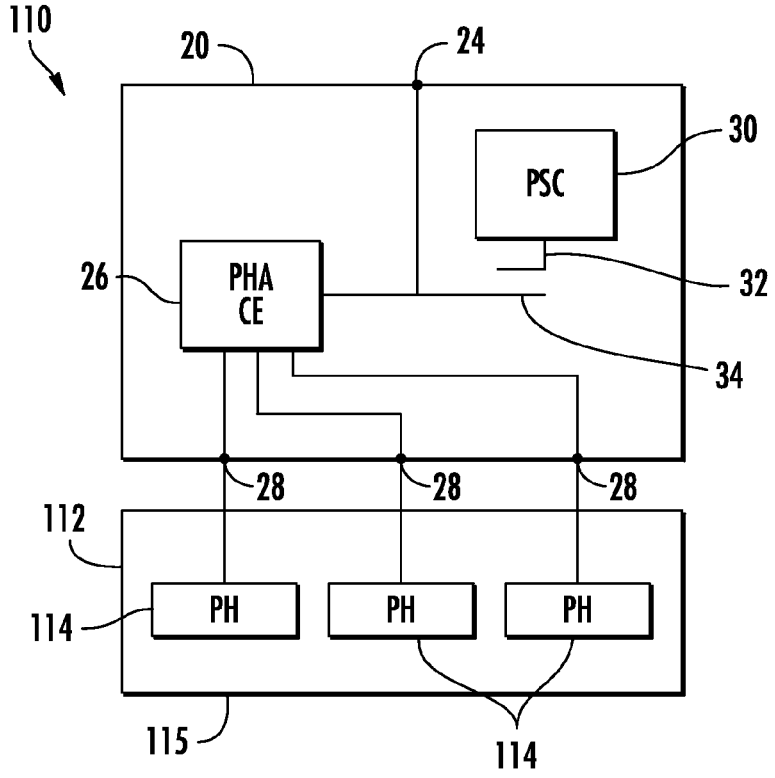
FIG. 2 is a schematic illustration of an example printing system including the printed circuit assembly of FIG. 1.

FIG. 2 schematically illustrates an example printing system 110 incorporating print head circuit assembly 20 (described above). In addition to printed circuit assembly 20, printing system 110 comprises print head array 112. Print head array 112 comprises a printhead module comprising an array of print heads 114 (schematically shown) arranged end-to-end (or in some implementations in a partially overlapping arrangement) so as to extend along an axis that is perpendicular to the direction of travel of print media and to at least partially span the print media. Print heads 114 receive power from printed circuit assembly 20 and eject ink or other fluid onto a print media. In one implementation, print heads 114 comprise thermal resistance inkjet print heads. In other implementations, print head 114 comprise piezo resistive inkjet print heads. Still other implementations, print heads 114 comprise other forms of drop-on-demand inkjet print heads having nozzles through which ink or fluid is selectively ejected.

Figure 3:
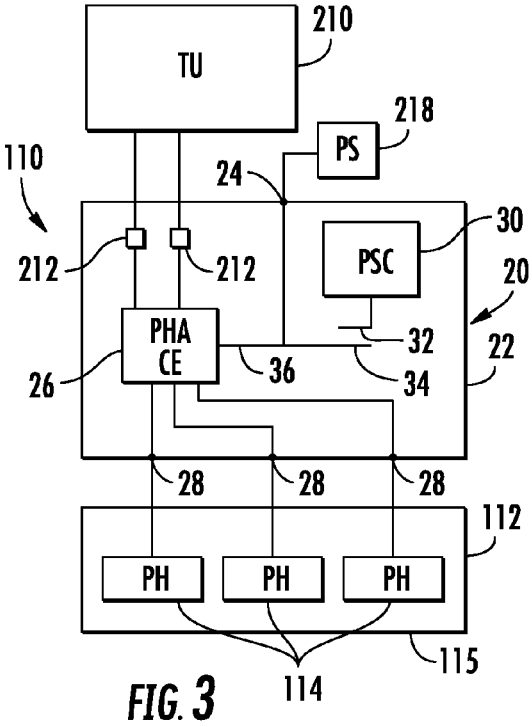
FIG. 3 is a schematic illustration of the printing system of FIG. 2 undergoing low-power testing within example test unit.
Figure 4:
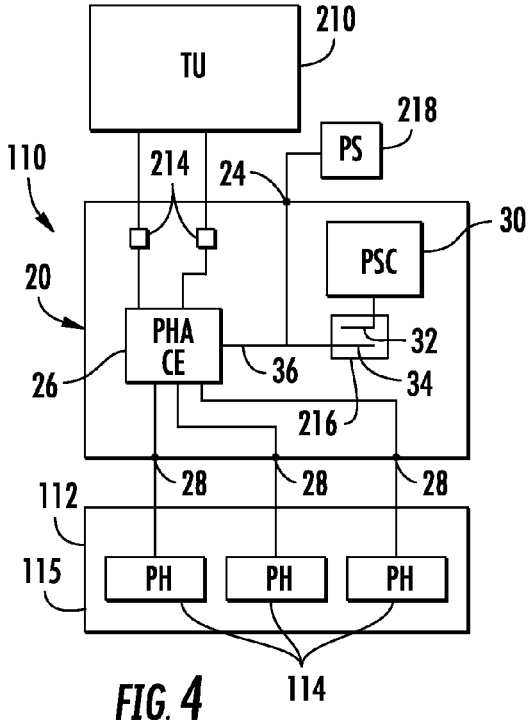
FIG. 4 is a schematic illustration of the printing system of FIG. 2 undergoing high-power testing with the example test unit with the power storage component in a connected state.
Figure 5:
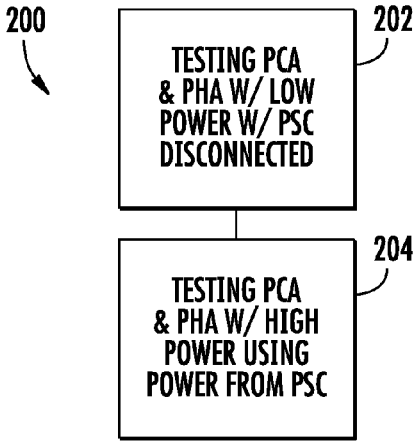
FIG. 5 is a flow diagram of an example method for testing the printing system of FIG. 2.

FIGS. 3 and 4 schematically illustrate testing of printing assembly 110 according to the example testing method 200 of FIG. 5. As indicated by step 202 of FIG. 5 and illustrated by FIG. 3, printed circuit assembly 20 and print head array 112 are tested with a low-power application to the printed circuit assembly 112 and print head array 112 while power storage component 30 is disconnected from power rail 36. In particular, as shown by FIG. 3, a testing unit 210 is electrically connected to a pair of electrically conductive low-power testing test pads 212 on printed circuit board 22 and electrical power is provided by testing unit 210 to perform a low-power test to verify electrical connections and functionality of printed circuit assembly 20 and print head array 112.

As indicated by step 204 and FIG. 4, printed circuit assembly 20 and print head array 112 are tested with a high-power application to the printed circuit assembly 112 and print head array 112 while power storage component 30 is connected to power rail 36. As shown by FIG. 4, power storage component 30 is electrically connected to power rail 36 by an inserted, applied or actuated connector 216 which electrically bridges (electrically shorts) electrical conductors 32 and 34 in the shorting region 40. As shown by FIG. 3, testing unit 210 is electrically connected to a pair of electrically conductive high-power testing test pads 214 on printed circuit board 22 and electrical power is provided by testing unit 210 to perform a print test. During the high-power testing which carries out a print test, the electrical power demands of print head array 112 may peak, at which times power from power supply 218 (schematically shown) may be incapable of satisfying electrical power demands of print head array 112. During such peak times, additional supplemental electrical power is provided by power storage component 30, simulating real-world print conditions for the print test.

In particular instances, steps 202 and 204 may be repeated multiple times prior to commercial sale or end use of the printer including printed circuit assembly 20 and print head array 112. For example, in one example testing regime, printed circuit assembly 20 is received with power storage components 30 installed but electrically disconnected from power rail 36. Print head dies 114 of the print head array 112 are then electrically connected to the printed circuit assembly 20 such as with a wire bond. Step 202 is then carried out to perform a low-power testing to verify electrical connections and functionality of each print head or print head die 114 while power supply component 30 remains disconnected. If printed circuit assembly 20 and print head array 112 pass the test, the connections between the print head dies 114 of print head array 112 and print head assembly 20 (outputs 28) are made permanent. In one implementation, such connections are encapsulated. Printed circuit assembly 20 and the connected printed dies 114 are then attached to a print bar body 115. At such point in time, step 204 is carried out to perform a high-power testing or print testing. If printed circuit assembly 20 and print head array 112 pass the high-power test, the print bars are shipped to the printer factory for assembly as part of a printer.

The printer factory may once again carry out steps 202 and 204. Prior to carrying out step 202, power storage component 30 may once again be disconnected from power rail 36 to perform the low-power test. Once functionality of each print head die and the electrical connections have been confirmed (ensuring that no damage has occurred during shipment), connector 216 is actuated, switched, or positioned to reconnect power storage component 30 to power rail 36 carry out the high-power test for print testing.

Figure 6:
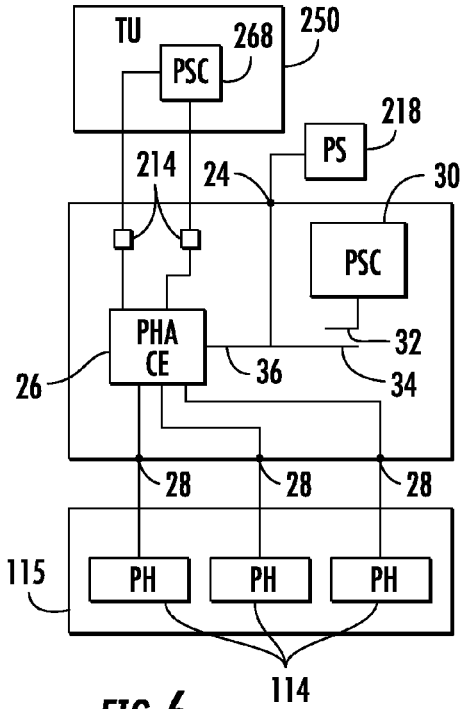
FIG. 6 is a schematic illustration of the printing system of FIG. 2 undergoing high power testing with another example test unit with the power storage component in a disconnected state.

FIG. 6 schematically illustrates an alternative testing arrangement for carrying out step 204. The testing arrangement shown in FIG. 6 utilizes a testing unit 250 which includes a power storage component 268. During high-power testing in which testing unit 250 is connected to test connection points or test pads 214, power storage component 30 may remain disconnected from power rail 36. During peak electrical power demands of print head array 112 when power supply 218 be not be capable of supplying sufficient power to meet the peak demand, power storage component 268 supplies the supplemental power (instead of power storage component 30).

The testing arrangement shown in FIG. 6 simplifies and may enhance accuracy for such testing. In particular, in those situations where steps 202 and 204 are to be carried out multiple times, such as at a manufacturing site and later again at a printer assembly site (described above), the use of testing unit 250 with its own power storage component 268 allows the initial high-power testing at the manufacturing site to be achieved without connection of power storage component 30 to power rail 36 using connector 26. After shipment to the printer assembly site, printed circuit assembly 20 and print head array 112 may be immediately ready for low-power testing; the power storage component 30 does not need to be changed from a connected state to a disconnected state. Reliability is enhanced as a result of power storage component 30 not being repeatedly connected and disconnected. Moreover, the final high-power testing of printed circuit assembly 20 may be performed with a permanent connector 216 connecting power storage 130 to power rail 36.

Figure 7:
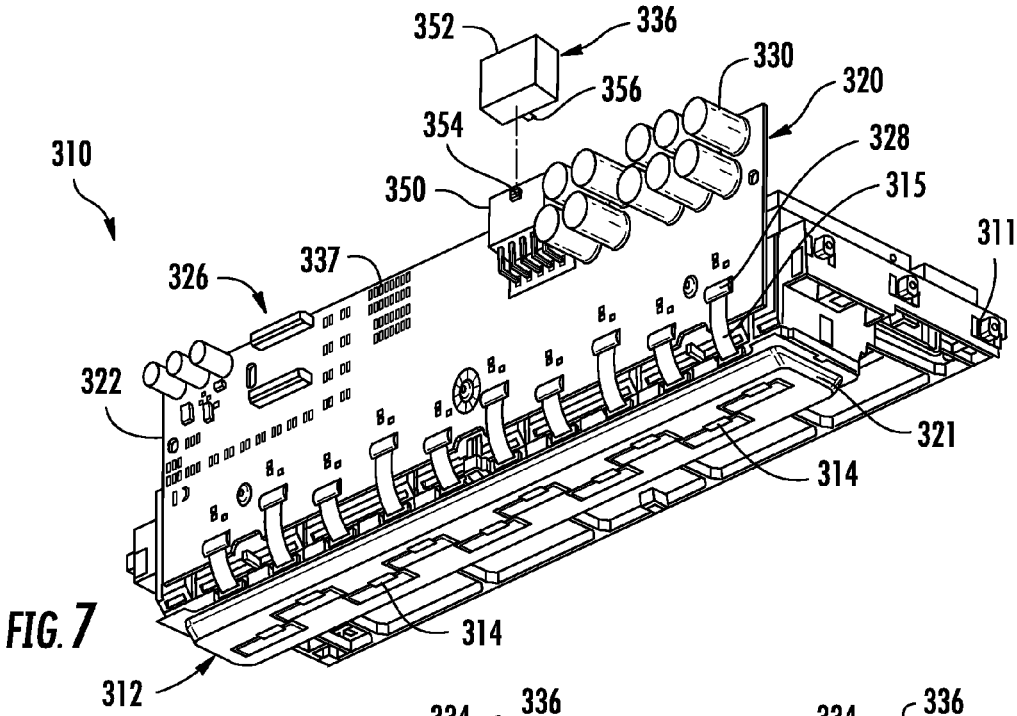
FIG. 7 is a perspective view of an example implementation of the printing system of FIG. 2 with the power storage component in a disconnected state.

FIG. 7 is a perspective view of printing system 310, an example implementation of printing system 110. Printing system 310 comprises a support 311, print head array 312, electrical interconnects 315 and printed circuit assembly 320. Support 311 comprises one or more structures that support print head array 312 and printed circuit assembly 320. In one implementation, support 311 comprises a frame of a printer that stationarily supports print head array 312, such as in a page-wide-array printer configuration. In other implementations, support 311 may be part of the carriage that is moved across and relative to the print medium. Support 311 may additionally support ink or fluid reservoirs (or conduits connected to such ink or fluid reservoirs) that supply ink or fluid to print head array 312.

Print head array 312 comprises a print module comprising print heads 314 and print bar 321. Print heads 314 (also referred to as print head dies) comprises a multitude of nozzles and corresponding inkjet engines (thermal resistive inkjet engines in the example illustrated) that selectively eject droplets of ink or fluid through such nozzles. In the example illustrated, each print head 314 or print head die 314 includes at least 2000 nozzles and nominally at least 4000 nozzles. In the example illustrated, the print module forming print head array 312 comprises at least 20,000,000 nozzles and nominally at least 40,000 nozzles. In the example illustrated, the number of nozzles of print head array printer and 12 are provided by at least eight and nominally 10 individual print heads 314 supported in a staggered, partially overlapping arrangement by print bar 315. The large number of nozzles provided by print head array 312 results in print head array 312 having relatively high peak power demands (the power to simultaneously fire fluid ejecting resisters of the many nozzles). Such high peak power demands may exceed the power supply capabilities of the AC to DC power supply providing power to print head array 312. In one implementation, print head array 312 has potential peak power demands exceeding 100 W.

Electrical interconnects 315 electrically connect print head array 312 to printed circuit assembly 320. In the example illustrated, electrical interconnects 328 comprise flexible circuits. In other implementations, such electrical interconnection may be achieved in other fashions.

Printed circuit assembly 320 comprises printed circuit board 322, print head array control electronics 326, power outputs 328, power storage component 330, electrical conductor 332 (schematically shown in FIG. 8), electrical conductor 334 (schematically shown in FIG. 8) and electrical connection connector 336. Printed circuit board 322 comprises a foundational support structure for printed circuit assembly 320. Printed circuit board 322 supports electrical traces as well as electronics or electrical componentry. In some implementations, printed circuit board 322 may comprise a rigid circuit board. In other implementations, printed circuit board 322 may comprise a flexible circuit board, flex circuit.

Print head array control electronics 326 comprise of electronics or electrical components on printed circuit board 322 which selectively supply power to a print head array to selectively actuate nozzles of the print head array 312 so as to eject ink or other fluid onto a surface in a pattern or image. Print head array control electronics 326 receive the electrical power from an AC to DC power supply through a power input and supplies power or controls the supply of power to the print head array through power outputs 328. During peak energy demand by print head array 312 (whether during actual printing or during high-power testing), electronics 326 may further receive power from or direct the transmission of power from power storage component 330 to print head array 312. To facilitate low-power testing and high-power testing, electronics 326 additionally comprises electrically conductive test connections or test pads 337 on the surface of printed circuit board 322.

Power storage component 330 comprises one or more power storage components that provide printed circuit assembly 320 with bulk capacitance. Power storage component 330 has a sufficient bulk capacitance to accommodate the peak electrical demands of larger, more power-consuming print head arrays 312 that are not satisfied through the power supplied from the AC to DC power supply. In one implementation, power storage component 330 comprises a plurality of bulk capacitors having a collective capacitance of at least 50 uF, nominally at least 1000 uF and at least 2500 uF in one implementation During low power demands of the print head array 312, power storage component 330 is charged, utilizing power received through the AC to DC power input. During peak power demands of the print head array printer 312 during which such demands may not be adequately met by the power received through the AC to DC power input, power storage component 330 supplies additional electrical power to the control electronics 326 and the print head array 312. Because power storage component 330 addresses the otherwise power inadequacies of the power supply during such peak demands, a lower capability and less complex power supply may be used to supply power and lower capability less complex control electronics 326 may be used to regulate and control the supply of power to the print head array, reducing size, cost and complexity.

Figure 8:
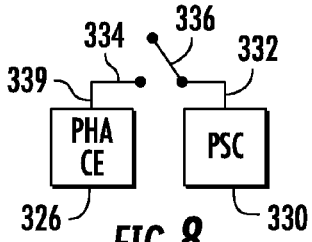
FIG. 8 is a schematic illustration of the printing system of FIG. 7.

FIG. 8 schematically illustrates electrical conductors 332 and 334. Electrical conductor 332 comprises an electrically conductive structure or trace formed on printed circuit board 322 and electrically connected to power storage component 330. Electrical conductor 334 comprises an electrically conductive structure or trace formed on printed circuit board 322 and electrically connected to control electronics 326 and outputs 328 for connection to a print head array 312.

As schematically shown in FIG. 8, electrical conductors 332 and 334 are electrically isolated from one another to disconnect power storage component 330 from the power rail 339 of printed circuit assembly 320 for low-power testing. Because power storage component 330 is not electrically connected to the power rail 339 (schematically shown) during low-power testing, power storage component 330 is not charged and does not delay such testing. At the same time, power storage component 330 is not connected as part of the circuit being tested, wherein the electrical leakage of the power storage component 330 might be sensed and mask real impactful electrical leakage and the rest of printed circuit assembly 320. As further schematically shown by FIG. 10, electrical conductor 332 and 334 are located in close proximity to one another to facilitate selective connection for high-power testing by electrical connection connector 336.

Electrical connector 336 comprises a mechanical shorting bar or mechanical switch to selectively connect and disconnect power storage component 330. In the example illustrated, electrical connection connector 336 comprises key receiver 350 and key 352. Key receiver 350 comprises a mechanical switch having terminals electrically connected to electrical conductors 332 and 334. Key receiver 350 is configured to receive and retain key 352. In the example illustrated, key receiver 350 comprises a female component having an opening 354 to receive a corresponding projection of key 352. As schematically shown by FIG. 8, prior to reception of key 352, connection connector 336 is in an open state, wherein electrical conductors 332 and 334 are likely isolated are electrically disconnected from one another to elect the disconnect power storage component 330 from electronics 326.

Figure 10:
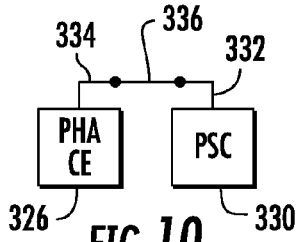
FIG. 10 is a schematic illustration of the printing system of FIG. 9.
Figure 9:
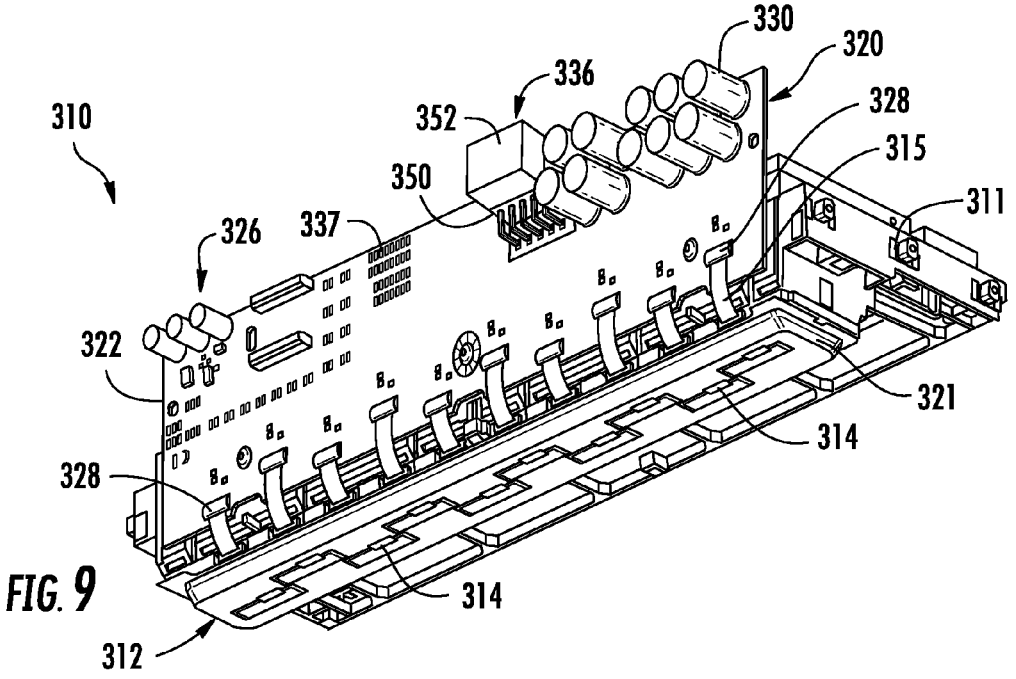
FIG. 9 is a perspective view of the printing system of FIG. 7 with the power storage component in a connected state.

Key 352 comprises a male component having a projection 356 configured to be received by opening 354. FIG. 9 illustrates insertion of projection 356 into opening 354. As schematically represented by FIG. 10, insertion of projection 356 of key 352 into opening 354 of key receiver 350 actuates connection connector 336 to a closed state, electrically connecting electrical conductors 332 and 334 to electrically connect power storage component 330 to electronics 326. Removal of key 352 from key receiver 350 reverts connection connector 336 to the open state shown in FIG. 8. Connection connector 336 facilitates repeated connection and disconnection of electrical conductors 332 and 334 and repeated connection and disconnection of power storage component 330. In other implementations, connector 336 may have a reverse configuration, wherein connection of key receiver 350 and key 352 results in disconnection of electrical conductors 332, 334 and wherein disconnection are separation of key receiver 350 and key 352 results in connection of electrical conductors 332, 334.

Figure 11:
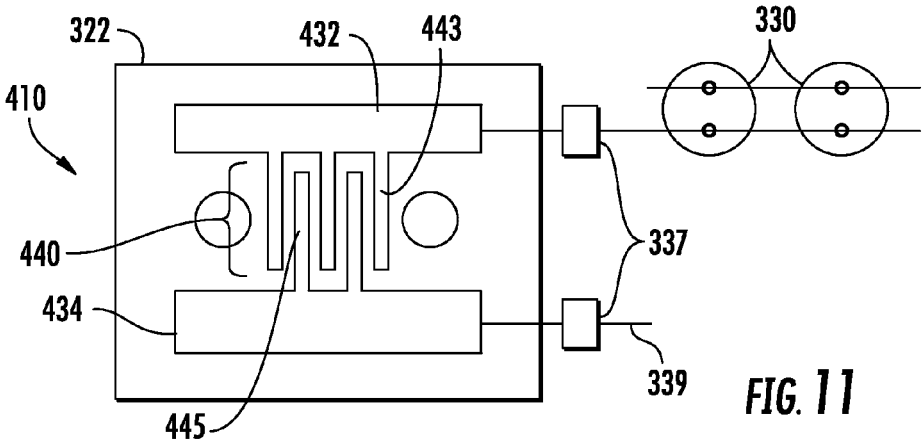
FIG. 11 is a top view of a portion of another example implementation of the printing system of FIG. 2 with a power source component in a disconnected state.

FIG. 11 illustrates a portion of printing system 410, another example implementation of printing system 110. Printing system 410 is identical to printing system 310 except that printing system 410 comprises electrical conductors 432, 434 and connector 436 in place of conductors 322, 334 and connector 336, respectively. The remaining components of printing system 410 illustrated in FIG. 11 that correspond to components of printing system 310 are numbered similarly.

Electrical conductor 432 comprises a first electrically conductive line having a first width. Electrical conductor 434 comprises a second electrically conductive line having a second width. Similar to electrical conductors 32 and 34 described above with respect to printed circuit assembly 20, electrical conductors 432, 434 are arranged so as to at least partially spatially overlap one another to form a shorting region 440 having a third width greater than the first width and the second width. In the example illustrated, electrical conductor 432 comprises a plurality of spaced electrically conductive fingers 443 while electrical conductor 434 comprises a plurality of spaced electrically conductive fingers 445 interleaved with fingers 443 to form an enlarged shorting region 440 for reliable inter-connection. In the example illustrated, electrical conductors 432 and 434 comprises non-contiguous, spaced parallel lines, such as parallel curved segments or parallel linear segments. In other implementations, other non-contiguous (not necessarily parallel) spatially overlapping arrangements may be utilized. The spatially overlapping arrangement of electrical conductors 432 and 434 facilitates reliable connection when high-power testing is to be performed and when printing system 410 is printing.

Figure 12:
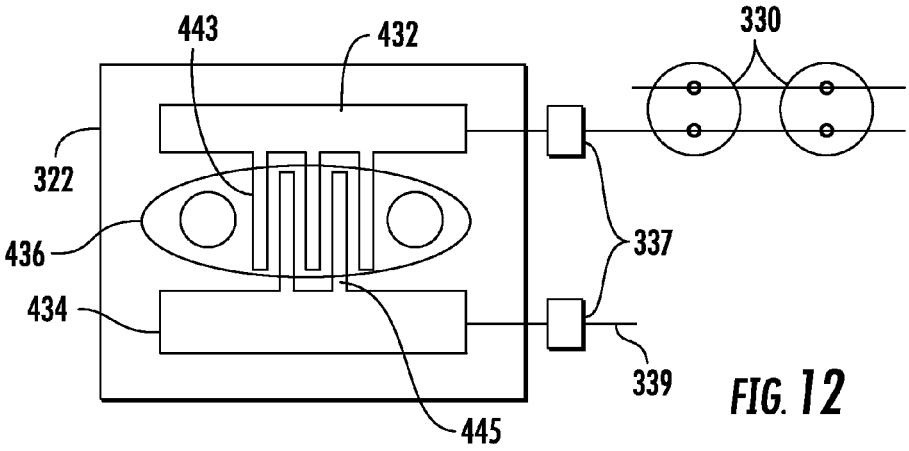
FIG. 12 is a top view of the portion of the printing system of FIG. 11 with the power source component in a connected state.

FIG. 12 illustrates printing system 410 further including connector 436 to ready printing system 410 for final high-power testing or to ready printing system 410 for non-testing printing use. Connector 436 comprises an additive electrically conductive material across and electrically interconnecting fingers 443 and 445 of conductors 432 and 434, respectively. In one implementation, connector 436 may comprise a metal plate, solder or other electrically conductive material temporarily or permanently affixed to printed circuit board 322. Connector 436 is especially useful when the testing regime shown in FIG. 6 is utilized to perform initial or non-final testing pursuant to step 204 of FIG. 5. In particular, initial or non-final testing may be utilized using testing unit 250 (shown in FIG. 6), wherein initial high-power testing utilizes power supplied by power storage component 268 while power storage component 330 is disconnected (in the absence of connector 436, wherein fingers 443 and 435 are not shorted or bridged). Subsequently, during readying of printing system 410 for a final high-power testing or after printing system 410 has passed such tests and is being readied for final shipment, connector 436 may be installed or applied to permanently electrically connect fingers 443 and 445 and to electrically connect power storage component 330 to power rail 339, electronics 326 and print head array 312.

Figure 13:
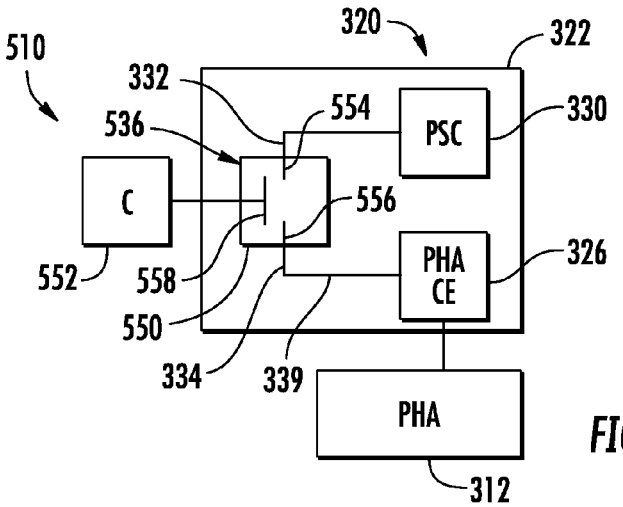
FIG. 13 is a schematic illustration of another example implementation of the printing system of FIG. 2.

FIG. 13 schematically illustrates a portion of printing system 510, another implementation of printing system 110. Printing system 410 is identical to printing system 310 except that printing system 410 comprises connector 536 in place of connector 336, respectively. The remaining components of printing system 510 illustrated in FIG. 13 that correspond to components of printing system 310 are numbered similarly. Connector 536 comprises an electrical switch that selectively connects and disconnects power storage component 330 from power out 339, electronics 326 and print head array 312. In the example illustrated, connector 536 comprises transistor 550 and controller 552. In one implementation, transistor 550 may comprise a transistor such as a MOSFET transistor. In other implementations, transistor 550 may comprise other types of transistors. In other implementations, transistor 550 may replaced with another type of electrical switch, such as one of more relays. Transistor 550 comprises source 554 electrically connected to conductor 332, drain 556 electrically connected to conductor 334 and gate 558 electrically connected to controller 552.

Controller 552 actuates transistor 550 to selectively connect and disconnect conductors 332 and 334. Controller 552 comprises one or more processing units configured to generate control signals for actuating transistor 550. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 552 may be embodied as part of one or more application-specific integrated circuits (ASICs). Unless otherwise specifically noted, the controller is not limited to any specific combination of hardware circuitry and software, nor to any particular source for the instructions executed by the processing unit. Controller 552 may be incorporated as part of print circuit assembly 320, as part of the printer incorporating printed circuit assembly 320, as part of a computing device, as part of a test unit or as part of another device that may control printing system 510.

Connector 536 facilitates repeated connection and disconnection of power storage component 330 under the control of controller 552. As a result, the manual step of connecting and disconnecting power storage component 330 may be avoided. With connector 536, subsequent testing of printing system 510 may be performed even after printing system 510 has been placed in end use. For example, as part of a troubleshooting process, the printer or computing device controlling the printer may perform a low-power test of printing system 510 by directing controller 552 to actuate transistor 552 disconnect power storage component 330. Such testing may be performed without manual disconnection of power storage component 330 or without disassembly of the printer containing printing system 510.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a printed circuit board;

a power storage component to supply energy to a print head array during peak electrical demand from the print head array when electrically connected to the print head array;

a first electrical conductor on the printed circuit board and electrically connected to the power storage component; and a second electrical conductor on the printed circuit board and electrically connected to the print head array, wherein the first electrical conductor and the second electrical conductor are electrically isolated from one another for low-power testing and are located proximate to one another for selective connection to one another for high-power testing.

2. The apparatus of claim 1 further comprising an electrical switch electrically coupled between the first electrical conductor and the second electrical conductor to selectively connect the first electrical conductor and the second electrical conductor.

3. The apparatus of claim 1 further comprising an electrical connector coupled between the first electrical conductor and the second electrical conductor, the electrical connector comprising:

a male component; and a female component removably receiving the mail component, wherein insertion of the male component with respect to the female component electrically connects the first electrical conductor and the second electrical conductor.

4. The apparatus of claim 1, wherein the first electrical conductor comprises a first electrically conductive line having a width, wherein the second electrical conductor comprises a second electrically conductive line having a second width and wherein the apparatus comprises a shorting region having a first portion electrically connected to the first electrically conductive line and a second portion electrically connected to the second electrically conductive line, the shorting region having a third width greater than the first width and the second width.

5. The apparatus of claim 1 further comprising a plurality of spaced interleaved electrically conductive fingers on the printed circuit board, a first portion of the fingers electrically connected to the first electrical conductor and a second portion of the fingers electrically connected to the second electrical conductor.

6. The apparatus of claim 1 further comprising an additive electrically conductive material across the first electrical conductor and the second electrical conductor.

7. The apparatus of claim 1, wherein the power storage component has a capacity of at least 50 uF.

8. The apparatus of claim 1 further comprising the print head array electrically connected to the second electrical conductor.

9. The apparatus of claim 1 further comprising a high-power testing unit electrically connected to the printed circuit board, the high-power testing unit comprising a power storage component to supply power to the grid array during peak electrical demand by the engine array during high-power testing.

10. The apparatus of claim 1 further comprising:

a first electrical testing pad electrically connected to the first electric conductor; and a second electrical testing pad electrically connected to the second electrical conductor.

11. A method comprising:

testing a printed circuit assembly and a print head array with a low-power application to a printed circuit assembly having a power storage component disconnected from a power rail of the printed circuit assembly;

testing the printed circuit assembly and the print head array with a high-power application to the printed circuit assembly with the printed circuit assembly receiving electrical power from the power storage component.

12. The method of claim 11, wherein the power storage component is on the printed circuit assembly and as a capacity of at least 50 uF.

13. The method of claim 11 further comprising testing the printed circuit assembly and the print head array with a second high-power application to the printed circuit assembly from a test unit with the printed circuit assembly receiving electrical power from a second power storage component of the test unit, wherein the second power storage component has a capacity of at least 50 uF.

14. The method of claim 11, wherein the power storage component is on the printed circuit assembly and wherein the method further comprises activating an electrical switch to disconnect the printed circuit assembly from the power storage component for testing a printed circuit assembly and the print head array with the first low power application.

15. An apparatus comprising:

a non-transient computer-readable medium containing computer-readable instructions to direct a processing unit to:

test a printed circuit assembly and a print head array with a low-power application to a printed circuit assembly having a power storage component disconnected from a power rail of the printed circuit assembly;

test the printed circuit assembly and the print head array with a high-power application to the printed circuit assembly with the printed circuit assembly receiving electrical power from the power storage component.

* * * * *